US007891955B2

(12) United States Patent
Picouet

(10) Patent No.: US 7,891,955 B2
(45) Date of Patent: Feb. 22, 2011

(54) COMPRESSOR HAVING A DUAL SLIDE VALVE ASSEMBLY

(75) Inventor: Jean Louis Picouet, Waukesha, WI (US)

(73) Assignee: Vilter Manufacturing LLC

( * ) Notice: Subject to any disclaimer, the term of this patent is extended or adjusted under 35 U.S.C. 154(b) by 891 days.

(21) Appl. No.: 11/677,868

(22) Filed: Feb. 22, 2007

(65) Prior Publication Data

US 2008/0206075 A1 Aug. 28, 2008

(51) Int. Cl.
*F04B 49/22* (2006.01)
*F01C 1/08* (2006.01)

(52) U.S. Cl. ..... 417/213; 417/299; 418/195; 418/201.2

(58) Field of Classification Search ..... 417/213, 417/299; 418/195, 201.2
See application file for complete search history.

(56) References Cited

U.S. PATENT DOCUMENTS

| | | | | |
|---|---|---|---|---|
| 774,551 | A | 11/1904 | Beaumont | |
| 3,088,659 | A | 5/1963 | Nilsson et al. | |
| 3,108,740 | A | 10/1963 | Schibbye | |
| 3,151,806 | A | 10/1964 | Whitfield | |
| 3,314,597 | A | 4/1967 | Schibbye | |
| 3,756,753 | A | 9/1973 | Persson et al. | |
| RE29,283 | E | 6/1977 | Shaw | |
| 4,261,691 | A | 4/1981 | Zimmern et al. | |
| 4,455,131 | A * | 6/1984 | Werner-Larsen | 418/201.2 |
| 4,478,054 | A | 10/1984 | Shaw et al. | |
| 4,583,373 | A | 4/1986 | Shaw | |
| 4,597,726 | A | 7/1986 | Söderlund et al. | |
| 4,610,612 | A | 9/1986 | Kocher | |
| 4,610,613 | A | 9/1986 | Szymaszek | |

(Continued)

FOREIGN PATENT DOCUMENTS

| | | | |
|---|---|---|---|
| JP | 57195889 | A1 | 10/1982 |

(Continued)

OTHER PUBLICATIONS

PCT Notification of Transmittal of the International Search Report and the Written Opinion of the International Searching Authority, or the Declaration, mailed Dec. 20, 2007 for International Patent Application PCT/US2007/05042, filed on Feb. 26, 2007.

(Continued)

*Primary Examiner*—Charles G Freay
(74) *Attorney, Agent, or Firm*—Whyte Hirschboeck Dudek SC

(57) ABSTRACT

A compressor having a dual slide valve assembly is disclosed. The slide valve assembly includes: i) a volume slide valve mechanism that is slidably movable to control compressor volume ratio and power input to the compressor; and ii) a capacity and volume slide valve mechanism that is in operational association with the volume slide valve mechanism, and the capacity and volume slide valve mechanism is slidably movable to control compressor capacity and to control volume ratio and power input to the compressor. In at least some embodiments, the compressor is a rotary gas compressor for a compression (e.g., refrigeration) system. A method of increasing compressor efficiency using the dual slide valve assembly is also disclosed. Compressor volume load and/or volume ratio and/or compressor power input can be simultaneously controlled by both the volume slide mechanism and the capacity and volume slide mechanism. Advantageously, compressor efficiency is increased.

21 Claims, 7 Drawing Sheets

U.S. PATENT DOCUMENTS

| | | | | |
|---|---|---|---|---|
| 4,611,976 | A | 9/1986 | Schibbye et al. | |
| 4,704,069 | A * | 11/1987 | Kocher et al. | 417/53 |
| 4,842,501 | A | 6/1989 | Schibbye et al. | |
| 5,435,704 | A * | 7/1995 | Sawyer | 418/201.2 |
| 2006/0008375 | A1 | 1/2006 | Hasegawa | |
| 2008/0240939 | A1 | 10/2008 | Picouet | |

FOREIGN PATENT DOCUMENTS

| | | | |
|---|---|---|---|
| WO | 2006085866 | A1 | 8/2007 |

OTHER PUBLICATIONS

PCT Notification of Transmittal of the International Search Report and the Written Opinion of the International Searching Authority, mailed Aug. 4, 2008 for International Patent Application PCT/US2008/058115, filed on Mar. 25, 2008.

* cited by examiner

COMPRESSOR HAVING A DUAL SLIDE VALVE ASSEMBLY

FIELD OF THE INVENTION

This invention relates generally to compressors and to adjustably positionable slide valves used in such compressors to control their operation. In one aspect, the invention relates to an improved slide valve assembly having independently positionable slide valves for regulating both compressor capacity and compressor volume.

BACKGROUND OF THE INVENTION

Compressors (e.g., rotary screw gas compressors) are used, for example, in compression systems (e.g., refrigeration systems) to compress refrigerant gas, such as "Freon", ammonia, natural gas, or the like. One type of rotary gas compressor employs a housing in which a motor-driven single main rotor having spiral grooves thereon meshes with a pair of gate or star rotors on opposite sides of the rotor to define gas compression chambers. The housing is provided with two gas suction ports (one near each gate rotor) and with two gas discharge ports (one near each gate rotor). Two dual slide valve assemblies are provided on the housing (one assembly near each gate rotor) and each slide valve assembly comprises a suction (also referred to as a "capacity slide valve") and a discharge slide valve (also referred to as a "volume slide valve") for controlling an associated suction port and an associated discharge port, respectively.

During operation of the compressor, a small amount of oil is continuously supplied to the compression chambers to provide an oil seal at points where the main rotor meshes with the gate rotors and with the housing to thereby effectively seal the chambers against gas leakage during gas compression. The oil flows out through the discharge ports and is recovered and recirculated. When the compressor is shut down and coasting to rest, excess oil can collect or settle in the compression chambers. When the compressor is restarted, the residual oil in the compression chambers, plus fresh oil entering the compression chambers, must be expelled through the discharge ports. U.S. Pat. Nos. 4,610,612, 4,610,613 and U.S. Pat. No. 4,704,069, all of which are assigned to the same assignee as the present application, disclose a dual-slide valve rotary gas compressor of the kind described above. The teachings and disclosures of each of these patents are incorporated by reference in their entireties herein.

The electric motors or engines employed to drive rotors in rotary compressors are usually of a type which requires the compressor to be unloaded while being started and brought up to some predetermined normal constant speed. Loading and unloading is accomplished by positioning of slide valves which control admission and discharge of gas into and from the compression chambers.

However, the operating efficiencies of current compressors, particularly when the compressors operate at maximum capacity, are still often less than an optimal level. Accordingly, an improved, more efficient, compressor is desired.

BRIEF SUMMARY OF THE INVENTION

In accordance with at least one aspect of the invention, a compressor having a dual slide valve assembly is disclosed. The slide valve assembly includes: i) a volume slide valve mechanism that is slidably movable to control compressor volume ratio and power input to the compressor; and ii) a capacity and volume slide valve mechanism that is in operational association with the volume slide valve mechanism, and the capacity and volume slide valve mechanism is slidably movable to control compressor capacity and to control volume ratio and power input to the compressor. In accordance with at least some embodiments, the compressor is a rotary gas compressor for a refrigeration system.

In accordance with another aspect of the invention, a method of increasing compressor efficiency is disclosed. The method includes providing a compressor having a housing and a slide valve assembly positioned at least partially within the housing, the assembly having a volume slide valve mechanism, and a capacity and volume slide valve mechanism that is in operational association with the volume slide valve mechanism. The method further includes slidably moving the volume slide valve mechanism to control compressor volume ratio and power input to the compressor, as well as slidably moving the capacity and volume slide valve mechanism to control compressor capacity. And the method still further includes slidably moving the capacity and volume slide valve mechanism to control volume ratio and power input to the compressor, thereby increasing compressor efficiency.

In accordance with still another aspect of the present invention, an assembly for use in a compressor is disclosed. The assembly includes a volume slide valve mechanism, the mechanism slidably movable to control compressor volume ratio and power input to the compressor. The assembly further includes a capacity and volume slide valve mechanism that is in operational association with the volume slide valve mechanism, the capacity and volume slide valve mechanism slidably movable to control compressor capacity and to control volume ratio and power input to the compressor.

Advantageously, a highly efficient compressor is provided herein. The compressor provides for at least one of the compressor volume ratio and compressor power input being simultaneously controlled by the volume slide mechanism and the capacity and volume slide mechanism of the slide valve assembly.

Various other aspects, objects, features and embodiments of the invention are disclosed with reference to the following specification, including the drawings.

BRIEF DESCRIPTION OF THE DRAWINGS

Embodiments of the invention are disclosed with reference to the accompanying drawings and are for illustrative purposes only. The invention is not limited in its application to the details of construction or the arrangement of the components illustrated in the drawings. The invention is capable of other embodiments or of being practiced or carried out in other various ways. Like reference numerals are used to indicate like components. In the drawings.

DETAILED DESCRIPTION OF THE PREFERRED EMBODIMENT(S)

Figure 1:
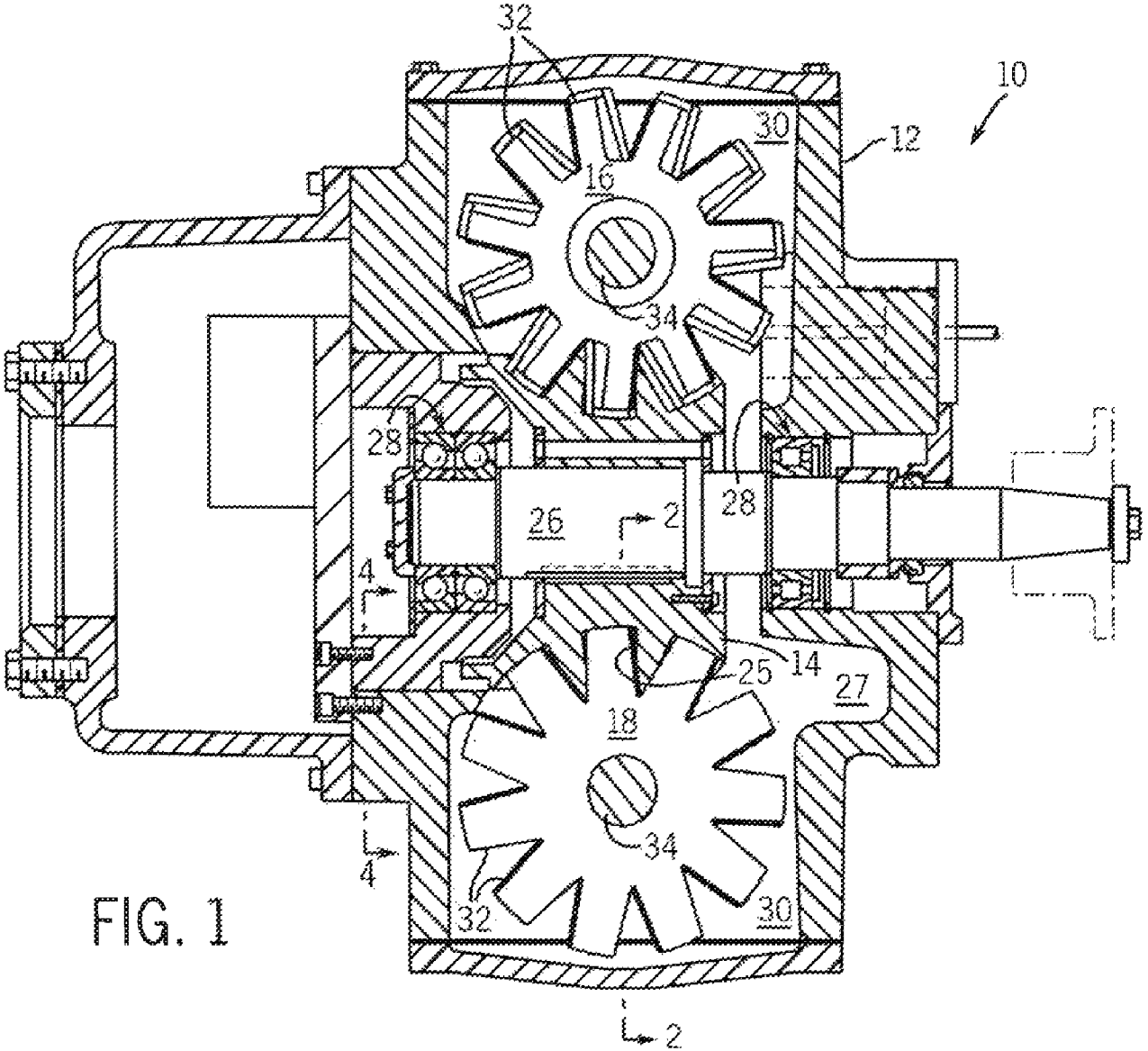
FIG. 1 is a top view, partly in cross-section and with portions broken away, of an exemplary rotary gas compressor employing a single screw rotor, a pair of star rotors and having dual slide valves (not visible) in accordance with at least some embodiments of the present invention.
Figure 2:
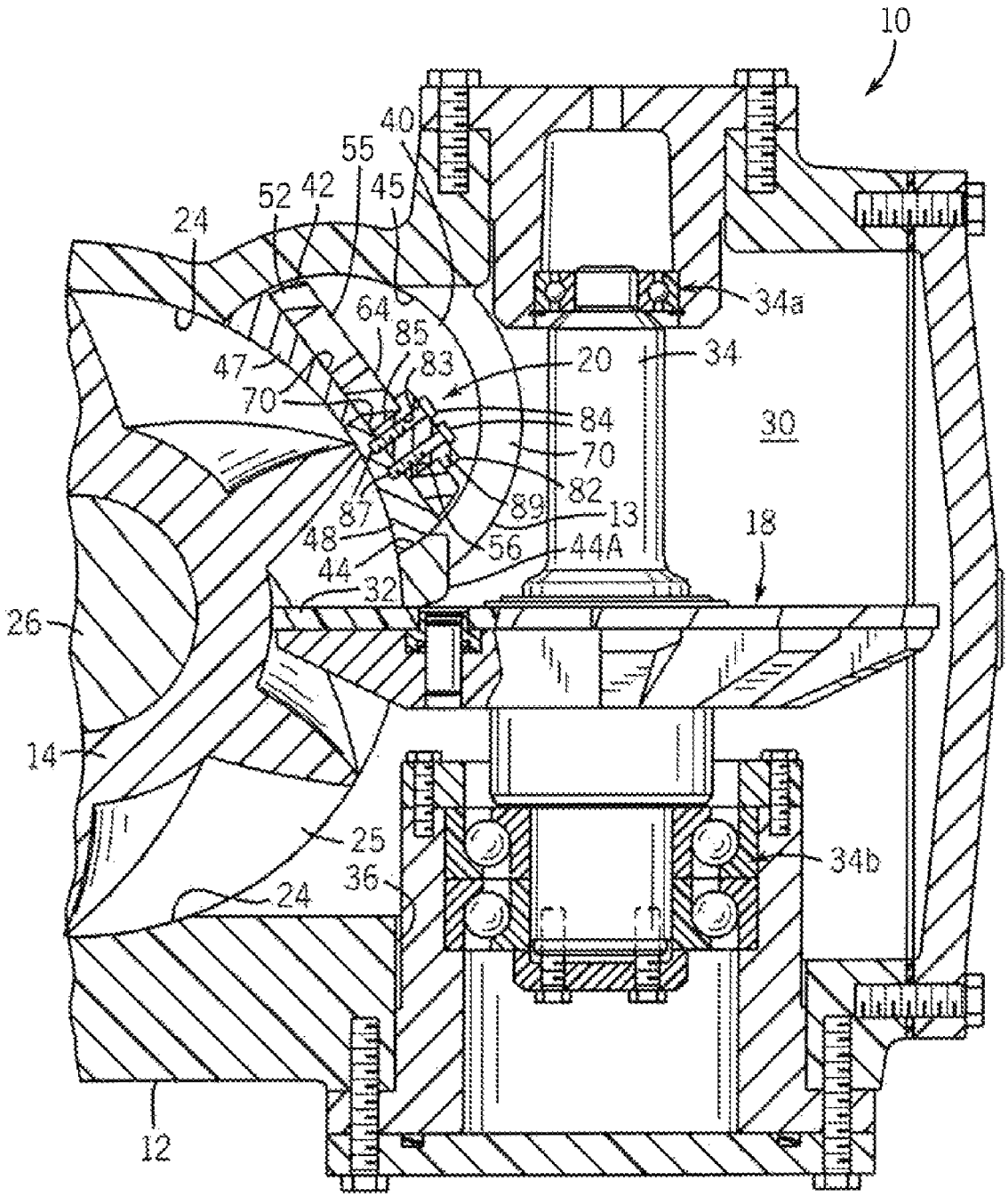
FIG. 2 is an enlarged cross-sectional view taken along line 2-2 of FIG. 1 and showing one set of dual slide valves in cross-section.

Referring to FIGS. 1 and 2, numeral 10 designates an exemplary embodiment of a rotary screw gas compressor adapted for use in a compression system (e.g., a refrigeration system) (not shown), or the like. Compressor 10 generally comprises a compressor housing 12, a single main rotor 14 mounted for rotation in housing 12, and a pair of star-shaped gate or star rotors 16 and 18 mounted for rotation in housing 12 and engaged with main rotor 14. Compressor 10 further includes two sets of dual slide valve assemblies 20 and 22 (shown as well in FIGS. 6A, 7A and 8A) mounted in housing 12 and cooperable with main rotor 14 to control gas flow into and from the compression chambers on the main rotor 14.

Compressor housing 12 includes a cylindrical bore 24 in which main rotor 14 is rotatably mounted. Bore 24 is open at its suction end 27 and is closed by a discharge end wall 29. Main rotor 14, which is generally cylindrical and has a plurality of helical grooves 25 formed therein defining compression chambers, is provided with a rotor shaft 26 (also shown in FIGS. 6A, 7A, and 8A) which is rotatably supported at opposite ends on bearing assemblies 28 mounted on housing 12.

Compressor housing 12 includes spaces 30 therein in which the star rotors 16 and 18 are rotatably mounted and the star rotors 16 and 18 are located on opposite sides (i.e., 180 degrees apart) of main rotor 14. Each of the star rotors 16 and 18 has a plurality of gear teeth 32 and is provided with a rotor shaft 34 which is rotatably supported at opposite ends on bearing assemblies 34A and 34B (FIG. 2) mounted on housing 12. Each of the star rotors 16 and 18 rotate on an axis which is perpendicular to and spaced from the axis of rotation of main rotor 14 and its teeth 32 extend through an opening 36 communicating with bore 24. Each tooth 32 of each of the star rotors 16 and 18 successively engages a groove 25 in main rotor 14 as the latter is rotatably driven by a motor (not shown) and, in cooperation with the wall of bore 24 and specifically its end wall 29, defines a gas compression chamber.

The two sets of dual slide valve assemblies 20 and 22 (only slide valve assembly 20 is shown in FIG. 1) are located on opposite sides (i.e., 180 degrees apart) of main rotor 14 and are arranged so that they are above and below (with respect to FIG. 2) their associated star rotors 16 and 18, respectively. Since the assemblies 20 and 22 are identical to each other, except as to location and the fact that they are mirror images of each other, only assembly 20 is hereinafter described in detail.

As will be understood, during normal running operation of the compressor, the gas pressure at the discharge/volume port of a compressor tends to vary substantially in response to variations in ambient temperatures resulting from seasonal or environmental temperature changes. Referring to the pressure-volume diagram in FIG. 3, if not corrected, the gas may be over-compressed in some situations, as when the discharge/volume port opens late with respect to an optimum opening point X, and this results in over-compression and extra work for the compressor, with resultant undesirable waste of electrical input power needed for operating the compressor because the gas is trapped in the rotor grooves for a longer period of time and its volume is reduced as its pressure is increased (i.e., the volume ratio is increased). Conversely, when the discharge/volume port opens early with respect to optimum point X, there is also a power loss because the volume ratio (i.e., the ratio of inlet gas volume to outlet gas volume) is lowered, i.e., the internal cylinder pressure at the point of discharge is lowered, thereby causing the compressor volume ratio to decrease. Advantageously, and in accordance with at least some aspects of the invention, the slide valve members move automatically to minimize the volume ratio of the machine.

Figure 5:
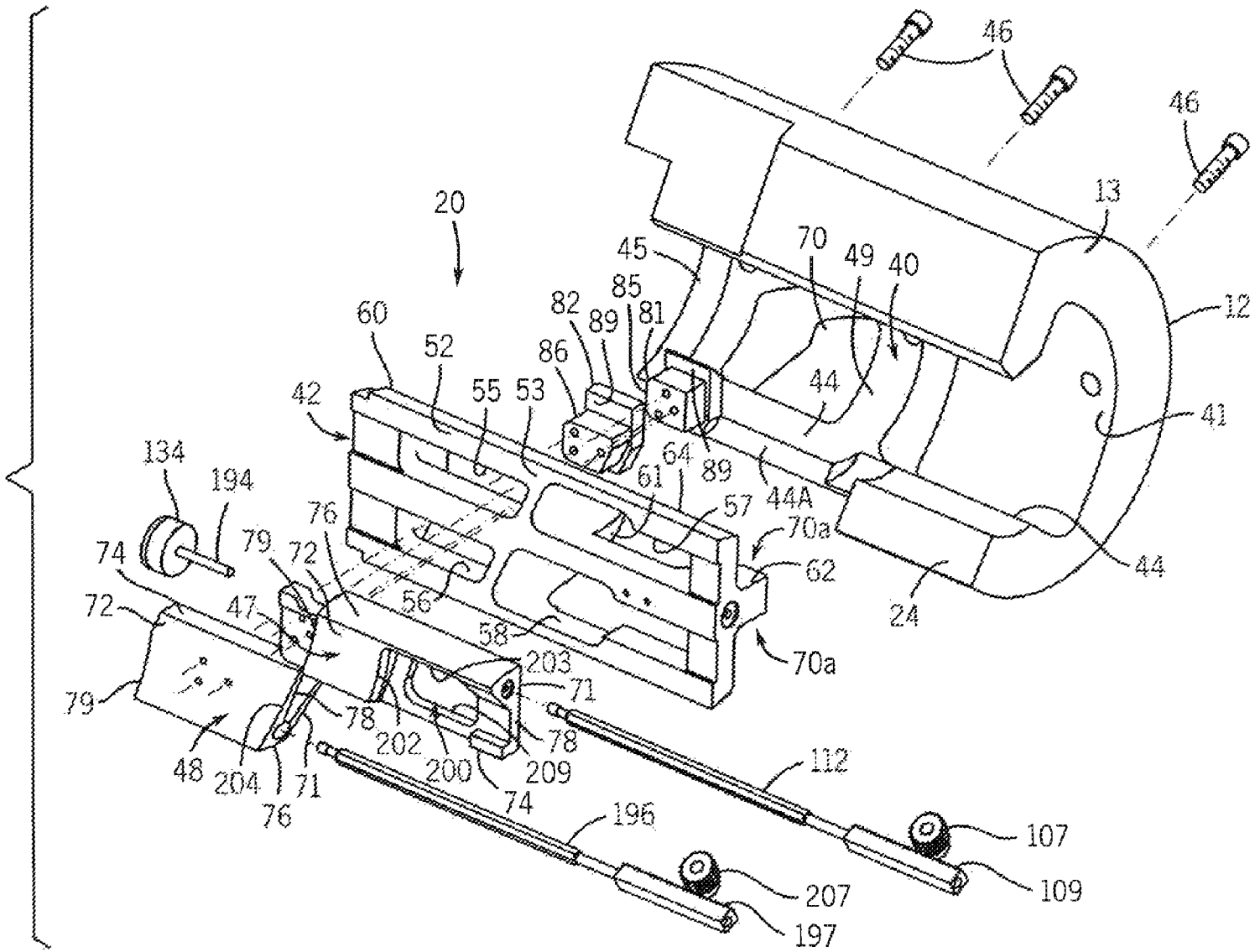
FIG. 5 is an exploded perspective view of one set of slide valves in accordance with at least some embodiments of the present invention, with the view taken from the discharge end of the compressor.

As FIGS. 2, 4, 5, 6A, 7A and 8A show, dual slide valve assembly 20 is located in an opening 40 which is formed in a housing wall 13 of housing 12 defining cylindrical bore 24. Opening 40 extends for the length of bore 24 and is open at both ends. As FIG. 5 shows, opening 40 is bounded along one edge by a member 44A (see also FIG. 2), a smooth surface 44, and has a curved cross-sectional configuration. Opening 40 is further bounded on its inside by two axially spaced apart curved lands 45 and 49. The space between the lands 45 and 49 is a gas inlet passage 70. Opening 40 is provided with chamfered or relieved portion 41 (see FIG. 5) at its discharge end which defines a gas port as hereinafter explained. Assembly 20 comprises a slide valve carriage 42 which is rigidly mounted in opening 40 by three mounting screws 46 (see FIG. 5) and further comprises two movable slide valve members or mechanisms, namely, a capacity and volume slide valve (i.e., dual-purpose) member 47 and a capacity slide valve member 48. Slide valve members 47 and 48 are slidably mounted on carriage 42 for movement in directions parallel to the axis of main rotor 14.

With reference specifically to FIG. 5, carriage 42 comprises a rectangular plate portion 52 having a flat smooth front side 53 and having four openings extending therethrough which are identified by, respectively, numerals 55, 56, 57 and 58 (indicating the surfaces or edges bounding the respective openings). Three spaced apart projections 60, 61 and 62 extend from the rear side 64 of plate portion 52 of carriage 42. A projection 60 mates with curved surface 44 and with curved land 45 bounding opening 40 and is secured thereto by one mounting screw 46. A projection 61 mates with curved surface 44 and with curved land 49 bounding opening 40 and is secured thereto by the second mounting screw 46. Such mating defines a space which is a continuation of gas inlet passage 70, and further defines gas inlet passages 70*a*. Projection 62 mates with curved surface 44 bounding opening 40, but projection 62 does not mate with land 49 (although third screw 46 attaches thereto) because relieved portion 41 provides a gas exhaust passage 66 (see FIGS. 6A, 7A and 8A). Thus, the two openings 55 and 56 in carriage 42 are in direct communication with gas inlet passage 70. The opening 58 in carriage 42 is in direct communication with gas exhaust passage 66.

The slide valve members 47 and 48 each take the form of a structural body having a flat smooth rear surface 71, a curved or contoured smooth front surface 72, a flat smooth inside edge 74, a curved smooth outside edge 76, and end edges 78 and 79. End edges 79 are both angled, as is rear surface 71 of slide valve member 48. End edge 78 of dual-purpose capacity and volume slide valve member 47 is straight. End edge 78 of the volume slide valve member 48 is slanted. Capacity and volume slide 47 further includes an opening 200, which is sized to be as large as possible for a given compressor. Further, this opening is shaped or contoured to correspond to the angle of the rotor groove when the rotor groove passes the slide valve member location. Additionally, the opening is in fluid communication with exhaust passage 57 via a hole bounded by an edge or surface 209. Volume and capacity slide 47 further includes angled edge 202 and edge 203 formed in and/or bounding opening 200, and volume slide 48 further comprises angled edge 204.

Figure 3:
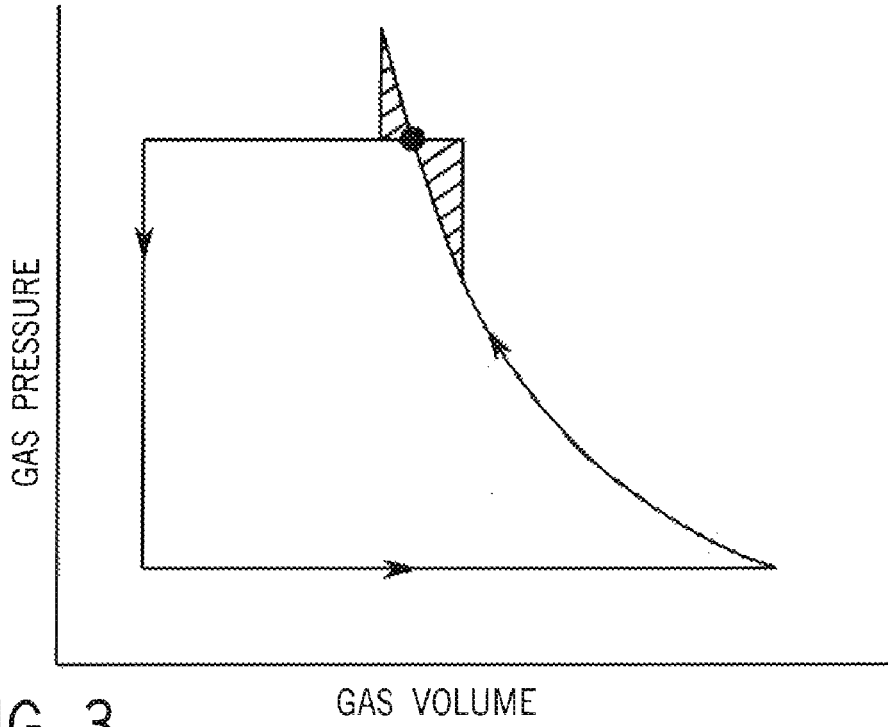
FIG. 3 is a graph showing a typical pressure-volume diagram for a compressor of the type disclosed herein.
Figure 4:
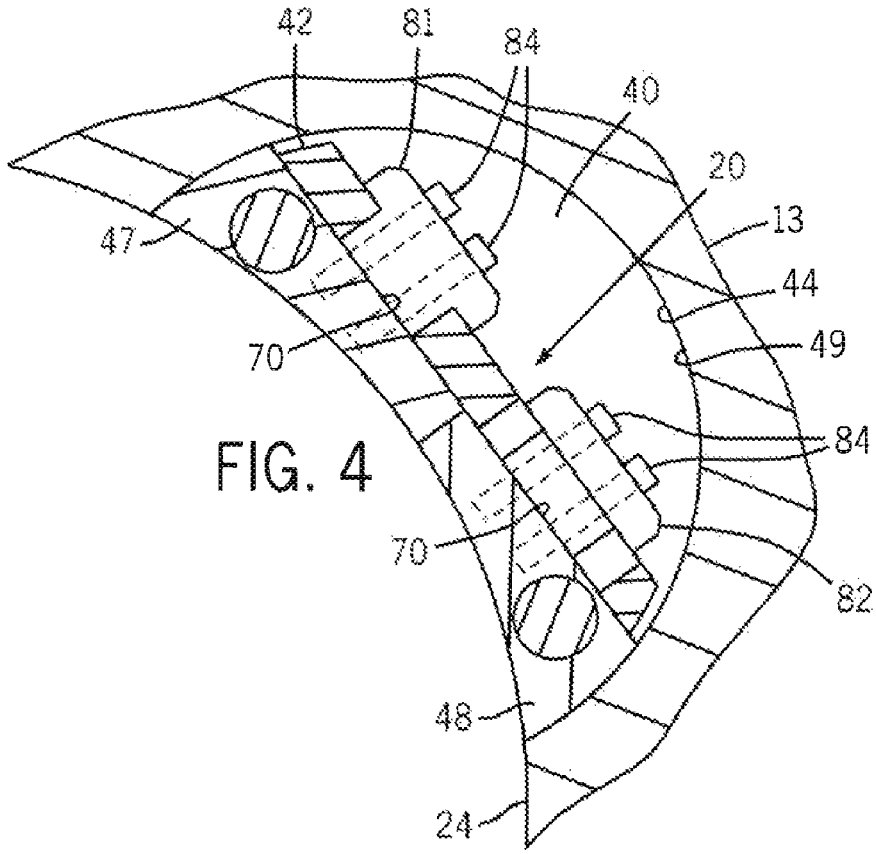
FIG. 4 is an enlarged cross-sectional view of one set of dual slide valves taken along line 4-4 of FIG. 1.

With reference to FIGS. 3 and 5, significantly, the slide valves 47 and 48 in accordance with the invention are movably positionable to adjust the location at which the discharge/volume ports 57 and 58 open. The preferred location is the point X in FIG. 3 at which internal gas pressure in the compression chambers on the rotor equals the condensing pressure in the system in which the compressor is employed.

Referring to FIGS. 2, 4, 5, 6A, 7A and 8A, rear surface 71 confronts and slides upon front side 53 of plate portion 52 of carriage 42. Front surface 72 confronts the cylindrical surface of main rotor 14 (FIG. 2). The inside edges 74 of the slide valve members 47 and 48 slidably engage each other. The outside edges 76 of the slide valve members confront and slidably engage the curved surfaces 44 adjacent opening 40 in bore 24. The slide valve members 47 and 48 are slidably secured to carriage 42 by clamping members 81 and 82, respectively, which are secured to the slide valve members by screws 84 (see FIGS. 2 and 4). The clamping members 81 and 82 have shank portions 85 and 86, respectively, which extend through the openings defined by numerals/surfaces 56 and 57, respectively, in carriage 42 and abut the rear surfaces 70 of the slide valve members 47 and 48, respectively. The screws 84 extend through holes 83 (FIG. 2) in the clamping members 81 and 82 and screw into threaded holes 87 (FIG. 2) in the rear of the slide valve members 47 and 48. The clamping members 81 and 82 have heads or flanges 89 which engage the rear side 64 of plate portion 52 of carriage 42.

With specific reference to FIG. 5, mechanisms for moving the slide valves 47 and 48 are also shown. Specifically, the assembly 20 includes rod 112 which includes rack teeth 109 thereon. Pinion gear 107 engages rack teeth 109 on the side of slide rod 112 which has one end rigidly secured to the end edge 78 of the slide valve member 47 of the slide valve assembly 20. Similarly, slide valve member 48 is moved using rod 196. Rod 196 includes rack teeth 197 thereon, and pinion gear 207 engages the rack teeth on the side of the rod which has an end rigidly secured to the end edge 78 of slide member 48. Piston-type actuator mechanism 134 can be used to effect the slide valve movement described herein. In general, movement (including independent movement of the slide valve mechanisms) can be accomplished by, for example, electrical or hydraulic actuators/motors.

In operation, the capacity and volume valve members 47 typically move in unison with each other, and the volume slide valve members 48 typically move in unison with each other. Each dual-purpose capacity and volume slide valve member 47 is slidably positionable (between full load and part load positions) relative to the port 55 to control where low pressure uncompressed gas from gas inlet passage 70 is admitted to the compression chambers or grooves 25 of main rotor 14 to thereby function as a suction by-pass to control compressor capacity. Each volume slide valve member 48 is slidably positionable (between minimum and adjusted volume ratio positions) relative to the discharge/volume port 58 to control where, along the compression chambers or grooves 25, high pressure compressed gas is expelled from the compression chambers 25, through discharge/volume port 58 to gas exhaust passage 66 (FIGS. 6A, 7A and 8A) to thereby control the input power to the compressor. The slide valve members 47 and 48 are independently movable by the separate piston-type actuators 134, an exemplary embodiment of which is shown. Known control means or system(s) operates to position the slide valves 47 and 48 for compressor start-up. The control means or system is also responsive, while the compressor is running, to compressor capacity and to power input, which is related to the location of the slide valves 47 and 48. Additionally, the control means or system operates the actuators to position the slide valve members 47 and 48 to cause the compressor to operate at a predetermined capacity and a predetermined power input. Importantly, the slide valve members or mechanisms 47 are capable of adjusting both the capacity between about 100% and 10% and volume ratio between about 1.2 to 7.0. The slide valve members or mechanisms 48 are capable of adjusting the volume ratio between about 1.2 to 7.0 so that power required by the compressor to maintain the desired capacity is at a minimum.

Figure 6A:
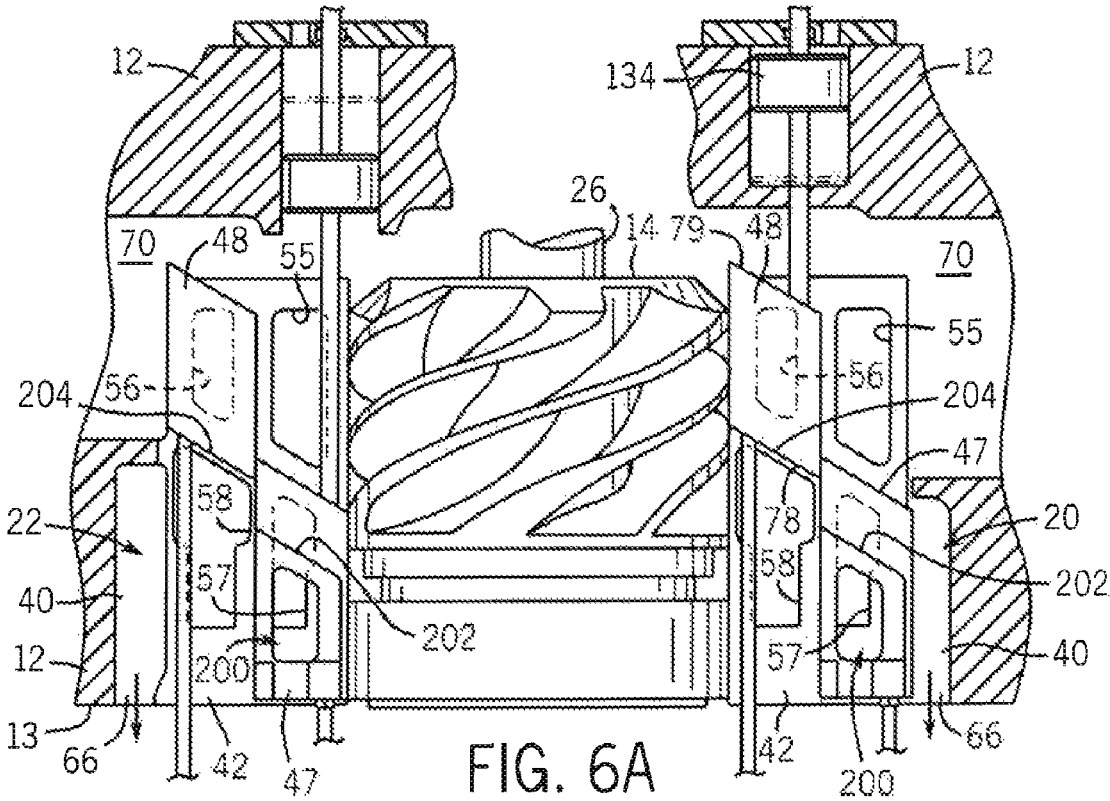
FIG. 6A is a top plan view of the compressor shown in FIGS. 1 and 2 with the dual slide valves in a start-up position in accordance with at least some embodiments of the present invention.
Figure 6B:
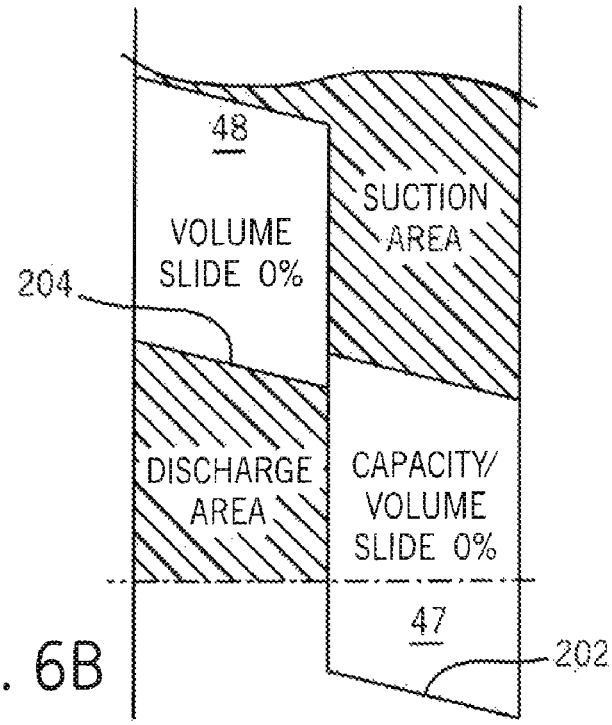
FIG. 6B is a schematic illustration corresponding to FIG. 6A showing the relative positioning of the dual slide valves in the start-up position.

With reference to FIGS. 6A-B, 7A-B and 8A-B, operation of independently movable dual-purpose capacity and volume slide valve 47 and volume slide valve 48 is described. Referring to FIGS. 6A-B, while compressor 10 having housing 12 is started and brought up to full speed, dual-purpose slide valve 47 is disposed (e.g., by a control means or apparatus) in its fully open or unloaded position (i.e., the 1.2 ratio position) to fully open gas suction/capacity port 55. Volume slide valve 48 is disposed in its minimum volume position (i.e., 1.2 ratio position) to fully open gas discharge/volume port 58, to enable excess oil in the gas compression chambers to exit freely through compressor gas discharge/volume port (and through gas exhaust passage, identified by numeral 66) before oil pressure build-up can occur. The angled edge 202 that is formed in opening 200 of capacity and volume slide 47 is also shown in a position relative to the angled edge 204 in volume slide 48. In the position illustrated (i.e., the start-up position), suction and discharge (volume) areas are maximized.

It should be further noted that, when both slide valves 47 and 48 are moved to the open positions shown in FIGS. 6A-B for start-up, neither gas nor oil is trapped or compressed in the compression chambers. FIG. 1.

Figure 7A:
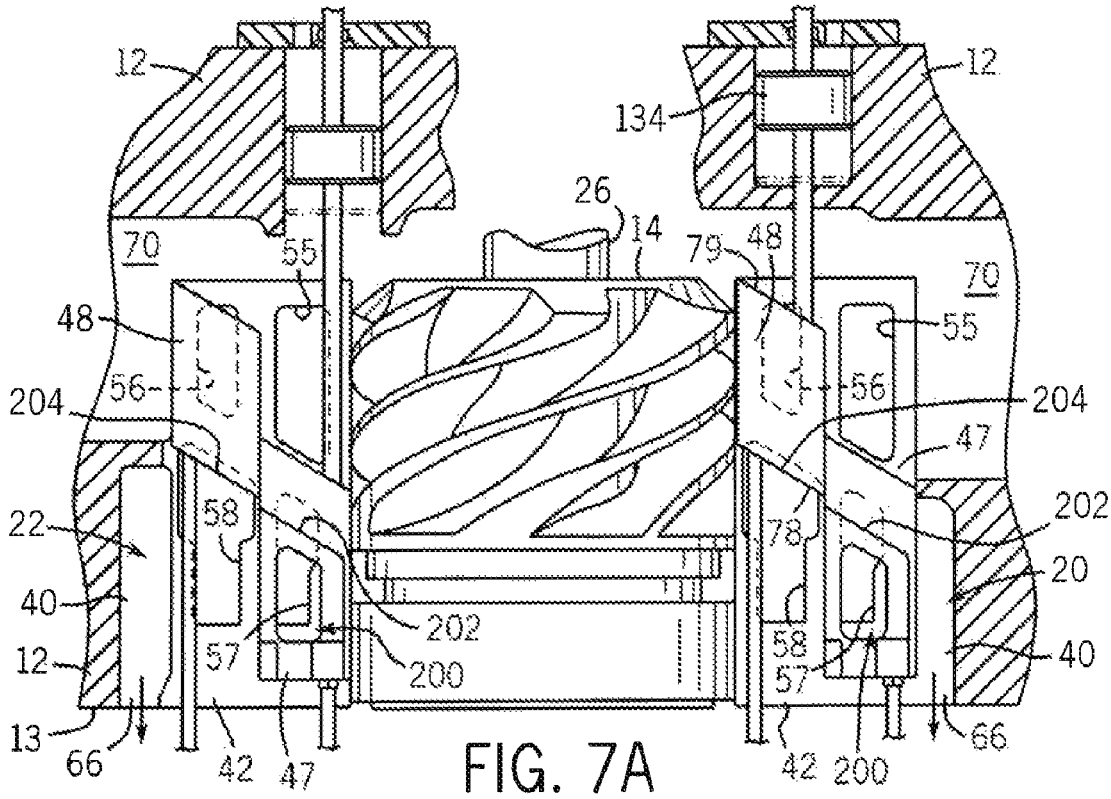
FIG. 7A is a view similar to FIG. 6A, but showing the dual slide valves being maintained in a typical running position and in accordance with at least some embodiments of the present invention.
Figure 7B:
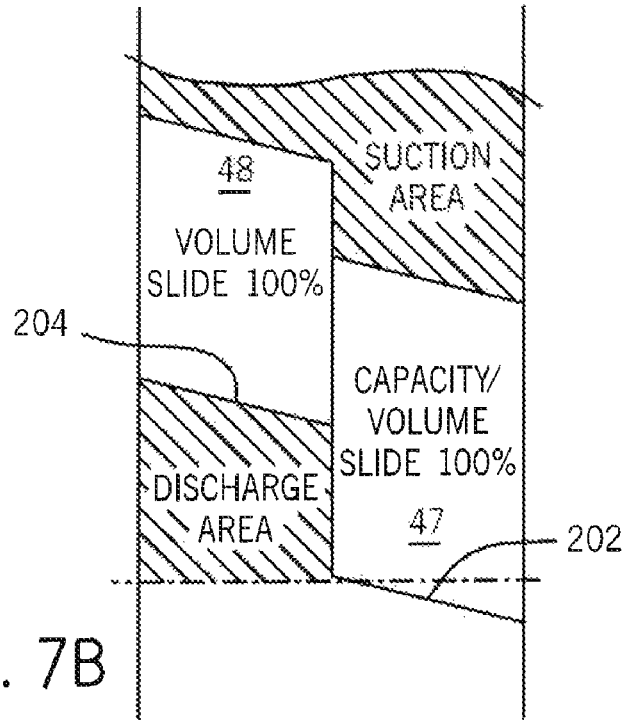
FIG. 7B is a schematic illustration corresponding to FIG. 7A showing the relative positioning of the dual slide valves, also in the running position.

Referring generally to FIGS. 7A-B, when compressor 10 is at full speed, dual-purpose volume and capacity slide valve 47 is positioned (e.g., by a control means, assembly, or apparatus) to maintain a desired gas suction pressure and volume slide valve 48 is positioned (e.g., again using a control means, assembly, or apparatus) to equalize gas pressure between the gas compression chambers and compressor gas discharge/volume port, designated by numeral 58. Volume and capacity slide valve 47 can be moved to some desired intermediate position wherein the suction/capacity port 55, is only partially open. The discharge/volume slide valve 48 can move from its minimum volume position wherein discharge/volume port 58 is fully open to some appropriate intermediate position, depending on operating conditions. On shut-down of compressor 10, both slide valves are returned to their start-up positions (shown in FIG. 7A). When compressor 10 is up to speed, volume and capacity slide valve 47 can remain in fully unloaded position wherein volume and capacity slide valve 47 maintains suction/capacity port 55 fully open. Furthermore, when compressor 10 is being operated (i.e., running at normal speed) at its minimum capacity, it is said to be "fully unloaded", and volume and capacity slide valve 47 assumes its fully open position whereby suction/capacity port 55 is fully open, whereas volume slide valve 48 assumes its closed or minimum volume position whereby discharge/volume port, 58, is fully closed. When the compressor is operating in some condition between fully unloaded and fully loaded conditions, the valves 47 and 48 can assume appropriate positions between their extreme positions to provide operation at the ideal volume ratio and thus optimum efficiency.

As specifically shown in FIGS. 7A-B, dual-purpose capacity and volume slide valve 47 is shown at 100% capacity load and maximum volume ration (i.e., 7.0 ratio) and volume slide valve 48 are shown in their partially-loaded (e.g., a 3.0 ratio) positions, with the relative positions reducing suction and discharge areas. More specifically, when compressor 10 is being operated (i.e., running at normal speed) at its maximum capacity, it is said to be "fully loaded". Dual-purpose volume and capacity slide valve 47 assumes its fully closed position shown whereby suction/capacity port 55 is fully closed, whereas volume slide valve 48 assumes a position whereby the compressor operates at optimal volume ratio and efficiency and discharge/volume port 58 is partially closed. The relative positions of the angled edge 202 and the angled edge 204 are also shown. As compared to the previous illustration shown in FIGS. 6A-B (i.e., the start-up position), suction and discharge areas have been reduced.

Figure 8A:
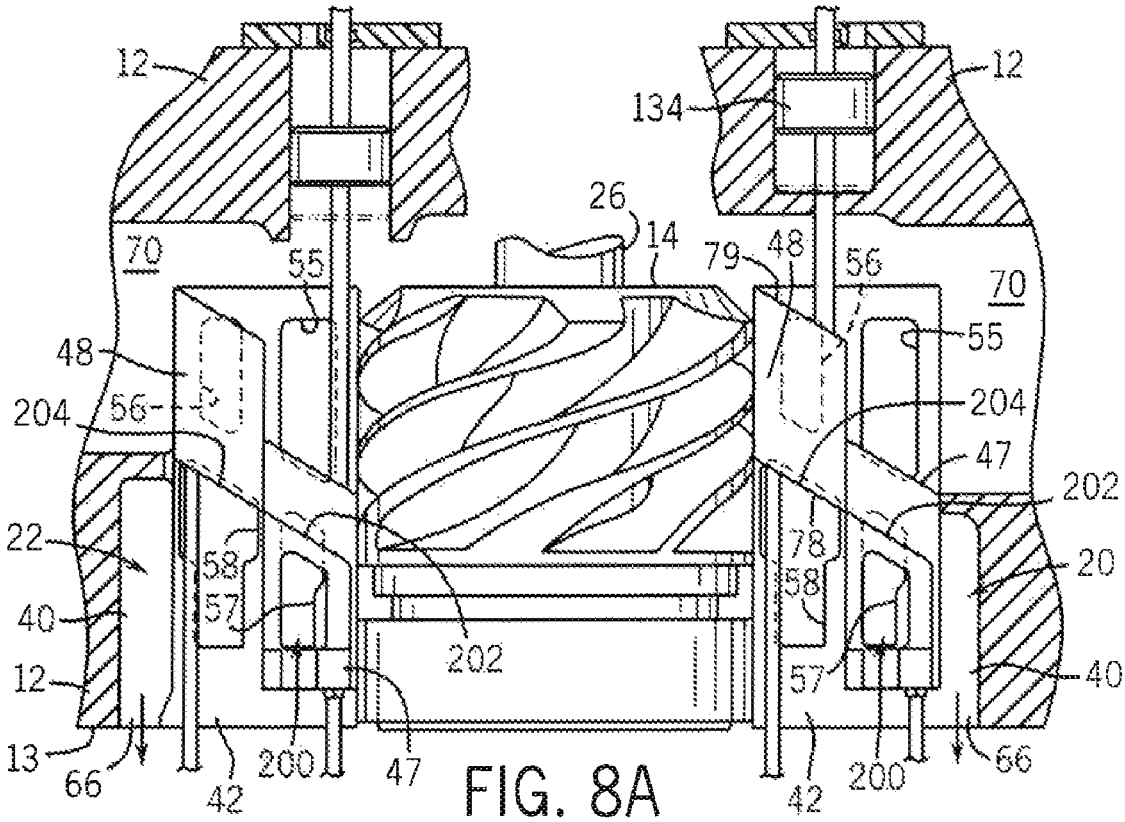
FIG. 8A is a view similar to FIGS. 6A and 7A, with the compressor operating at maximum capacity and showing the "dual-functionality" of one of the slide valve mechanisms.
Figure 8B:
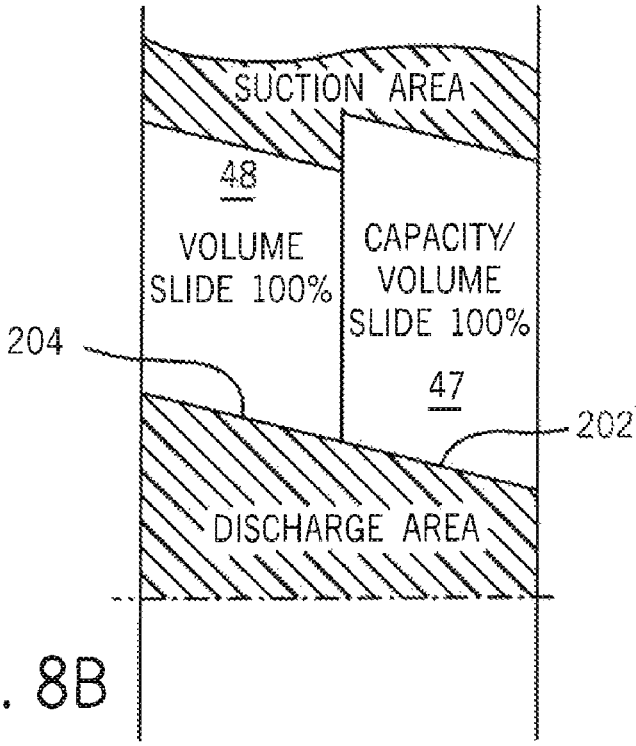
FIG. 8B is a schematic illustration corresponding to FIG. 8A showing the relative positioning of the dual slide valves and the dual-functionality of one of the slide valve mechanisms.

When the slide valves 47 and 48 are both at 100%, or fully loaded, compressor efficiency can be diminished. This is particularly due to diminished discharge area (as shown in FIGS. 7A-B). Turning to FIGS. 8A-8B, and in accordance with at least some embodiments of the present invention, when compressor 10 is being operated (i.e., running at normal speed) at its maximum capacity, and when the volume and capacity slide 47 reaches its fully loaded position, slide 47 can continue to move. More specifically, volume and capacity slide 47 can, while remaining at 100% load, match volume slide 48, which is loaded to match a given compression (volume ratio). Therefore slide 47 can serve as volume slide (thus the slide or slide valve is termed a "dual-purpose" or "dual-functionality" slide member or mechanism). Stated another way, compressor volume ratio can be simultaneously controlled by both the volume slide mechanism and the capacity and volume slide mechanism. Discharge/volume ports 57 and 58 are opened and, the discharge area is increased. As shown, and in accordance with at least one aspect of the present invention, volume and capacity slide valve 47 is moved with respect to volume slide 48 such that angled edge 202 moves and is aligned with angled edge 204. Advantageously, and as a result, compressor efficiency is increased. More specifically, optimum efficiency of the compressor can be achieved (i.e., corresponding to point X at FIG. 3 referenced above).

Various components can be provided to connect together the capacity and volume slide valve members 47 of the two dual slide valve assemblies 20 and 22 so that volume slide valve members 48 move in unison with each other when slid to appropriate and/or desired positions.

Components, assemblies and/or means are provided and/or described in accordance with the present invention to establish the start-up positions of the slide valves 47 and 48, to relocate them in desired positions suitable for the load condition desired when the compressor is up to speed, and to determine the positions for the slide valves 47 and 48 which would provide the most efficient volume ratio for the selected load condition. These means, assemblies, etc., could, for example, take the form of or include a microprocessor circuit (not shown) in the controller which mathematically calculates these slide valve positions, or they could take the form of or include pressure sensing devices.

It should also be noted that in the preferred embodiment disclosed herein the two valve members 47 (on opposite sides of the rotor) are typically moved in synchronism with each other and the two valve members 48 (on opposite sides of the rotor) are moved in synchronism with each other so as to provide for "symmetric" unloading of the compressor. However, each slide valve member in a pair can be moved independently of the other so as to provide for "asymmetrical" unloading of the compressor, if appropriate linkages (not shown) are provided and if the control system is modified accordingly in a suitable manner.

When the compressor operates at low capacity, inefficiency results and power losses increase substantially. Half of such inefficiency would be attributable to losses on one side of the rotor. Therefore, the advantages of such independent valve member movement as above-described is that, when the compressor is unloaded to a point where, for example, about 50% of total compressor capacity is reached, it would then be possible to effectively "shut off" one side of the compressor and eliminate all losses associated with the "shut off" side of the compressor. Although this might result in some radial load imbalance on the rotor, this could be acceptable under some circumstances, or provisions could be made to compensate for such imbalance.

Again, many other variations to the compressor dual slide valve assembly, its components, and the compressor in which it is utilized are possible and considered within the scope of the claims. For example, it is contemplated that the compressor gases themselves at various points in the system, could be used directly to effect positioning of the slide valves 47 and 48, if suitable structures (not shown) are provided. Moreover, the holes, ports, channels, and the like can be sized and shaped depending on the compressor type and application at hand. Similarly, the size and shape of structural or mechanical components shown and/or described herein can be varied without departing from the scope of the present invention.

Accordingly, it is specifically intended that the present invention not be limited to the embodiments and illustrations contained herein, but include modified forms of those embodiments including portions of the embodiments and combinations of elements of different embodiments as come within the scope of the following claims.

I claim:

1. A compressor comprising:

a housing;

a slide valve assembly positioned at least substantially within the housing, the assembly comprising:

a volume slide valve mechanism, the mechanism slidably movable to control compressor volume ratio and power input to the compressor; and a capacity and volume slide valve mechanism that is in operational association with the volume slide valve mechanism, the capacity and volume slide valve mechanism slidably movable to control compressor capacity and to control volume ratio and power input to the compressor;

wherein the capacity and volume slide mechanism further includes an opening or port which is at least one of: i) sized at least in part based on a desired compressor volume ratio; ii) shaped or contoured to correspond to a rotor groove angle of the rotor; iii) in fluid communication with an exhaust passage; and wherein the capacity and volume slide valve mechanism further includes an edge bounding the opening or port, and the volume slide valve mechanism includes an edge, and wherein the capacity and volume slide valve mechanism is movable with respect to the volume slide mechanism such that the capacity and volume slide valve mechanism edge is aligned with the volume slide valve mechanism edge so as to increase efficiency of the compressor.

2. The compressor of claim 1 wherein at least one of the compressor volume ratio and compressor power input can be simultaneously controlled by both the volume slide mechanism and the capacity and volume slide mechanism.

3. The compressor of claim 1 wherein the compressor is a rotary gas compressor for a refrigeration system and the compressor further comprises a helically grooved main rotor having a rotor axis and the main rotor is mounted for rotation about the rotor axis within the housing.

4. The compressor of claim 3 wherein the volume slide valve mechanism is slidably movable at least substantially parallel to the axis of the main rotor relative to a volume port and wherein the capacity and volume slide valve mechanism is slidably movable at least substantially parallel to the axis of the main rotor relative to a capacity port.

5. The compressor of claim 1 wherein the capacity and volume slide mechanism further includes an opening or port which is at least one of i) sized at least in part based on a desired compressor volume ratio; ii) shaped or contoured to correspond to a rotor groove angle of the rotor; and iii) in fluid communication with an exhaust passage.

6. The compressor of claim 1 wherein the capacity and volume slide valve mechanism includes an edge, the volume slide valve mechanism includes an edge and the capacity and volume slide valve mechanism is movable with respect to the volume slide mechanism such that the capacity and volume slide valve mechanism opening is aligned with the volume slide valve mechanism edge so as to increase efficiency of the compressor.

7. The compressor of claim 6 wherein both the volume slide valve mechanism edge and the capacity and volume slide valve mechanism edge are each angled.

8. The compressor of claim 1 wherein the compressor is a rotary gas compressor for a compression system and the compressor further comprises a helically grooved main rotor having a rotor axis and the main rotor is mounted for rotation about the rotor axis within the housing; and wherein the volume slide valve mechanism is slidably movable at least substantially parallel to the axis of the main rotor relative to a volume port and wherein the capacity and volume slide valve mechanism is slidably movable at least substantially parallel to the axis of the main rotor relative to a capacity port.

9. The compressor of claim 1 wherein the volume slide valve mechanism and the capacity and volume slide valve mechanism are independently movable.

10. The compressor of claim 1 wherein the compressor is a rotary gas compressor for a compression system and the compressor further comprises a helically grooved main rotor having a rotor axis and the main rotor is mounted for rotation about the rotor axis within the housing, and further wherein each of the slide valve mechanisms includes a face complementary to and confronting said main rotor in sliding sealed relationship.

11. The compressor of claim 10 wherein the slide valve mechanisms are disposed in a common recess in side-by-side sliding relationship.

12. A rotary screw gas compressor for a compression system comprising:

a compressor housing;

a motor-driven main rotor having helical grooves and mounted for rotation on a rotor axis in a rotor bore in said compressor housing;

a pair of gate rotors rotatably mounted in said housing and engageable with said helical grooves to define a plurality of gas compression chambers; and a slide valve assembly positioned at least substantially within the housing, the assembly comprising:

a volume slide valve mechanism, the mechanism slidably movable to control compressor volume ratio and power input to the compressor; and a capacity and volume slide valve mechanism that is in operational association with the volume slide valve mechanism, the capacity and volume slide valve mechanism slidably movable to control compressor capacity and to control volume ratio and power input to the compressor;

wherein compressor volume ratio can be simultaneously controlled by both the volume slide mechanism and the capacity and volume slide mechanism;

wherein the capacity and volume slide mechanism further includes a first opening or port which is of least one of: i) sized at least in part based on a desired compressor volume ratio; ii) shaped or contoured to correspond to a groove angle of the helical grooves; and iii) in fluid communication with an exhaust passage; and wherein the capacity and volume slide valve mechanism includes an edge bounding the first opening or port, and the volume slide valve mechanism includes an edge, and wherein the capacity and volume slide valve mechanism is movable with respect to the volume slide mechanism such that the capacity and volume slide valve mechanism edge is aligned with the volume slide valve mechanism edge so as to optimize compressor efficiency.

13. The compressor of claim 12 wherein said compressor comprises a pair of volume slide valve mechanisms and a pair of capacity and volume slide valve mechanisms, with one volume slide valve mechanism and one capacity and volume slide valve mechanism being located on one side of said main rotor and the other volume slide valve mechanism and the other capacity and volume slide valve mechanism being located on another side of said main rotor.

14. The compressor of claim 13 wherein the first of the pair of slide valve mechanisms is disposed in a recess, with each of the pair of slide valve mechanisms in side-by-side sliding relationship, and the second of the pair of slide valve mechanisms is disposed in a another recess, with each of the pair of slide valve mechanisms in side-by-side sliding relationship, and wherein the first recess is circumferentially spaced 180 degrees from the other common recess.

15. A method of increasing compressor efficiency, the method comprising:

providing a compressor having a housing and a slide valve assembly positioned at least partially within the housing, the assembly having a volume slide valve mechanism, and a capacity and volume slide valve mechanism that is in operational association with the volume slide valve mechanism; wherein the capacity and volume slide mechanism further includes an opening or port which is at least one of: i) sized at least in part based on a desired compressor volume ratio; and ii) in fluid communication with an exhaust passage; and wherein the capacity and volume slide valve mechanism further includes an edge bounding the first opening or port, and the volume slide valve mechanism includes an edge;

slidably moving the volume slide valve mechanism to control compressor volume ratio and power input to the compressor, slidably moving the capacity and volume slide valve mechanism to control compressor capacity;

slidably moving the capacity and volume slide valve mechanism to control volume ratio and power input to the compressor, thereby increasing compressor efficiency;

aligning the capacity and volume slide valve mechanism edge with the volume slide valve mechanism edge.

16. The method of claim 15 and wherein control of compressor volume ratio can be accomplished by simultaneously slidably moving of both the volume slide mechanism and the capacity and volume slide mechanism.

17. The method of claim 15 wherein the compressor is a rotary gas compressor for a compression system and the compressor further comprises a main rotor having a rotor axis and the main rotor mounted for rotation about the rotor axis within the housing; and wherein the capacity and volume slide mechanism is shaped or contoured to correspond to a groove angle of the helical grooves, the method further comprising slidably moving the volume slide mechanism at least substantially parallel to the axis of the main rotor relative to a volume port and slidably moving the capacity and volume slide valve mechanism at least substantially parallel to the axis of the main rotor relative to a capacity port.

18. A method of increasing compressor efficiency, the method comprising:

providing a compressor having a housing and a slide valve assembly positioned at least partially within the housing, the assembly having a volume slide valve mechanism, and a capacity and volume slide valve mechanism that is in operational association with the volume slide valve mechanism;

slidably moving the volume slide valve mechanism to control compressor volume ratio and power input to the compressor, slidably moving the capacity and volume slide valve mechanism to control compressor capacity; and slidably moving the capacity and volume slide valve mechanism to control volume ratio and power input to the compressor, thereby increasing compressor efficiency;

wherein, during compressor operation at, or substantially at, a maximum compressor capacity, the method further comprises slidably moving the capacity and volume slide mechanism, when the volume and capacity slide reaches, or substantially reaches, a fully loaded position, to match volume slide valve mechanism, which is also at a fully loaded position, such that the capacity and volume slide increases a compressor discharge area and functions as volume slide valve mechanism.

19. An assembly for use in a compressor, the assembly comprising:

a volume slide valve mechanism, the mechanism slidably movable to control compressor volume ratio and power input to the compressor; and a capacity and volume slide valve mechanism that is in operational association with the volume slide valve mechanism, the capacity and volume slide valve mechanism slidably movable to control compressor capacity and to control volume ratio and power input to the compressor;

wherein the capacity and volume slide mechanism further includes an opening or port which is at least one of: i) sized at least in part based on a desired compressor volume ratio; ii) shaped or contoured to correspond to a rotor groove angle of a rotor; and iii) in fluid communication with an exhaust passage;

wherein the capacity and volume slide valve mechanism further includes an edge bounding the respective opening or port, and wherein the volume slide valve mechanism includes an edge, and further wherein the capacity and volume slide valve mechanism is movable relative the volume slide mechanism such that the capacity and volume slide valve mechanism edge is aligned with the volume slide valve mechanism edge to increase efficiency of the compressor;

wherein the assembly is a slide valve assembly that is positionable at least substantially within a housing of a compressor and the assembly is capable of operation with an additional slide valve assembly having an additional volume slide valve mechanism that is also slidably movable to control compressor volume ratio and power input to the compressor, and an additional capacity and volume slide valve mechanism that is also slidably movable to control compressor capacity and to control volume ratio and power input to the compressor.

20. The assembly of claim 19 wherein at least one of the compressor volume ratio and compressor power input can be simultaneously controlled by the volume slide mechanism and the capacity and volume slide mechanism.

21. The assembly of claim 19 wherein the assembly is in operable association with the additional slide valve assembly having the additional volume slide valve mechanism and an additional capacity and volume slide valve mechanism and wherein the additional capacity and volume slide mechanism further includes an opening or port which is at lease one of: i) sized at least in part based on a desired compressor volume ratio; ii) shaped or contoured to correspond to a rotor groove angle of a rotor; and iii) in fluid communication with an exhaust passage; wherein the additional capacity and volume slide valve mechanism further includes an edge bounding the opening or port, and wherein the additional volume slide valve mechanism includes an edge, and further wherein the additional capacity and volume slide valve mechanism is movable relative the additional volume slide mechanism such that the additional capacity and volume slide valve mechanism edge is aligned with the additional volume slide valve mechanism edge to increase efficiency of the compressor.

* * * * *